United States Patent [19]

Eskeli

[11] 4,047,392

[45] Sept. 13, 1977

[54] DUAL ROTOR HEAT EXCHANGER

[76] Inventor: Michael Eskeli, 7994-41 Locke Lane, Houston, Tex. 77042

[21] Appl. No.: 407,665

[22] Filed: Oct. 18, 1973

Related U.S. Application Data

[63] Continuation-in-part of Ser. No. 219,212, Jan. 20, 1972, Pat. No. 3,791,167, and Ser. No. 386,207, Aug. 6, 1973, abandoned.

[51] Int. Cl.[2] ..... F25B 9/00; F25D 9/00; F28D 11/02

[52] U.S. Cl. ..... 62/402; 165/86; 415/64; 415/114; 415/178; 416/96 R

[58] Field of Search ..... 415/64, 178, 177, 179, 415/114, 199 A; 416/95, 96; 126/247; 62/401, 402, 403; 122/26; 165/86

[56] References Cited

U.S. PATENT DOCUMENTS

| | | | |
|---|---|---|---|
| 2,247,410 | 7/1941 | Ross | 192/58 |
| 2,490,064 | 12/1949 | Kollsman | 62/402 |
| 2,490,065 | 12/1949 | Kollsman | 62/402 |
| 2,522,781 | 9/1950 | Exner | 62/401 |
| 2,526,103 | 10/1950 | Wood | 62/136 |
| 2,529,765 | 11/1950 | Exner | 62/401 |
| 2,757,521 | 8/1956 | Bennett | 62/402 |
| 3,791,167 | 2/1974 | Eskeli | 62/401 |

FOREIGN PATENT DOCUMENTS

| | | | |
|---|---|---|---|
| 633,985 | 6/1937 | Germany | 165/86 |

*Primary Examiner*—C. J. Husar
*Assistant Examiner*—Sheldon Richter

[57] ABSTRACT

A method and apparatus for generating heat and vaporizing of liquids, and for providing cooling by using a continuous flow centrifuge to compress a gas with accompanying temperature increase and removing heat to another fluid from said gas in compressed state; said gas then being passed from the first rotor via nozzles mounted on said first rotor in backward direction thus reducing the absolute tangential velocity of said gaseous fluid; said gaseous fluid being then passed to a second rotor for which the rotor tip speed may be nearly the same as the velocity of said entering gaseous fluid. After said gaseous fluid enters the second rotor, it is then passed inward within said second rotor and discharged near said second rotor center. Work is supplied to said first rotor normally, and recovered in said second rotor. The gaseous fluid may be air, carbon dioxide, or some other fluid. The fluid receiving said heat may be water, ammonia, or some other fluid. A third fluid may be employed to add heat to said gaseous fluid during expansion; then said gaseous fluid is directly returned to said first rotor; said third fluid may be water, or be some other fluid.

3 Claims, 5 Drawing Figures

DUAL ROTOR HEAT EXCHANGER

CROSS REFERENCES TO RELATED APPLICATIONS:

This application is a continuation-in-part of patent application "Rotary Heat Exchanger with Dual Rotors", filed Jan. 20, 1972, Ser. No. 219,212, now U.S. Pat. No. 3,791,167 and "Rotary Heat Exchanger with Dual Rotors", filed Aug. 6, 1973, Ser. No. 386,207 abandoned.

This invention relates generally to devices for generating heating and vaporizing fluids, and to devices for generating cooling, by compressing a gas within a continuous flow centrifuge and removing heat from said gas in a compressed state, and then adding heat to said gaseous first fluid after expansion of said first fluid.

Various types of heat pumps have been made in the past. These devices are generally inefficient and costly to construct.

It is an object of this invention to provide a method and apparatus for the generation of heating and cooling, and for vaporization of liquids, wherein a gas is compressed within a first rotor, and then discharged from nozzles mounted near the periphery of said first rotor for reduced work input to the heat exchanger, and for control of flow of said gaseous first fluid, with said first fluid then being passed to a second rotor for expansion and recovery of work, and with heat addition to said first fluid either within said second rotor or discharging said first fluid after said expansion.

Figure 1:
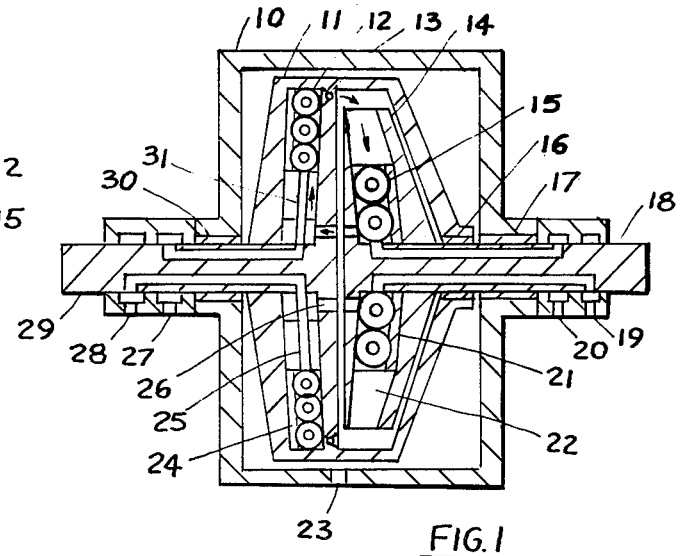
FIG. 1 is a cross section of one form of the heat exchanger.

Referring to FIG. 1, therein is illustrated a cross section of one form of the heat exchanger. 10 is casing, 11 is first rotor, 12 is first rotor heat exchanger, 13 are first rotor nozzles, 14 is second rotor, 15 is second rotor heat exchanger, 16 is seal, 17 is bearing, 18 is second rotor shaft, 19 and 20 are third fluid entry and exit to second rotor heat exchanger, 21 is second rotor heat exchanger support plate, 22 are second rotor vanes, 23 is opening to space within casing, 24 is first rotor heat exchanger support plate, 25 is first rotor vane, 26 is first fluid passage form second rotor cavity to first rotor cavity, 27 and 28 are second fluid entry and exit to first rotor heat exchanger, 29 is first rotor shaft, 30 is bearing, 31 is second fluid distribution conduit.

Figure 2:
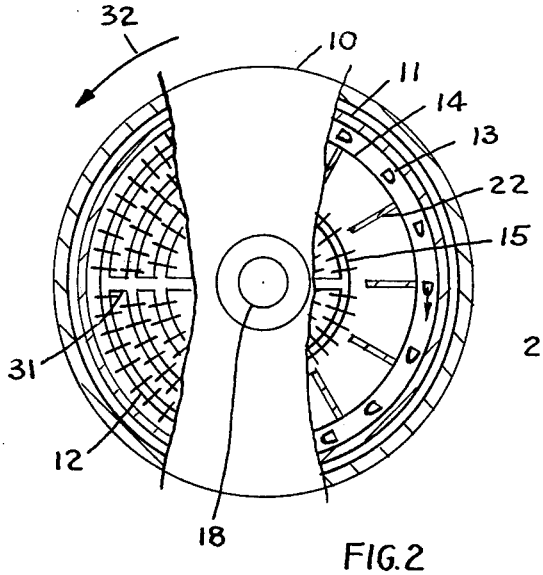
FIG. 2 is an end view of the unit shown in FIG. 1.

In FIG. 2, an end view of the unit shown in FIG. 1 is illustrated with portions removed to show interior details. 10 is casing, 11 is first rotor, 14 is second rotor, 13 are first fluid nozzles, 22 are second rotor vanes, 15 is second rotor heat exchanger, 18 is second rotor shaft, 12 is first rotor heat exchanger, 31 second fluid distribution conduit, and 32 indicates direction of rotation for both rotors.

Figure 3:
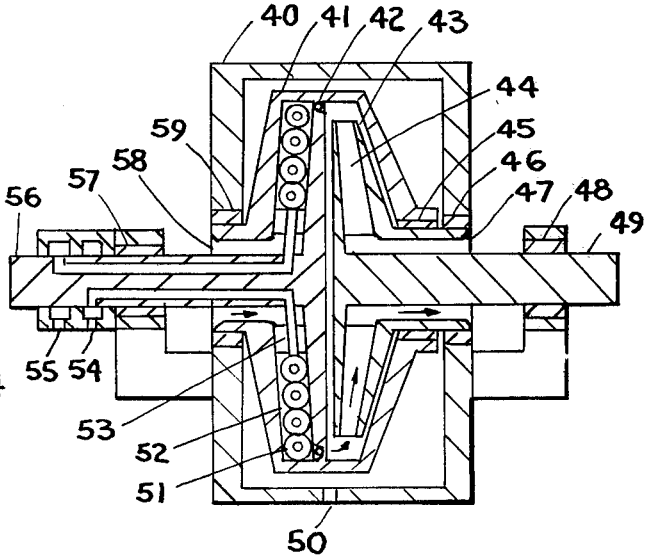
FIG. 3 is a cross section of another form of the device.

In FIG. 3, another form of the heat exchanger is shown in cross section. 40 is casing, 41 is first rotor, 42 is nozzle, 43 is second rotor, 44 are second rotor vanes, 45 is seal, 46 is seal, 47 is first fluid exit, 48 is bearing supporting second rotor shaft 49, 50 is opening to casing space, 51 is first rotor heat exchanger supported by plate 52, 53 is vane, 54 and 55 are entry and exit for second fluid to heat exchanger 51, 56 is first rotor shaft, 57 is bearing, 58 is first fluid entry to first rotor, 59 is seal.

Figure 4:
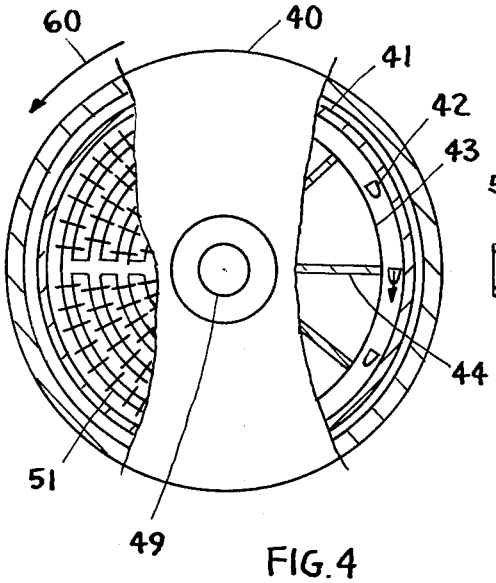
FIG. 4 is an end view of the unit of FIG. 3.

In FIG. 4, an end view of the unit shown in FIG. 3 is illustrated with portions removed to show interior details. 40 is casing, 41 is first rotor, 42 are nozzles, 43 is second rotor, 44 are second rotor vanes, 49 is shaft, 51 is heat exchanger, and 60 indicates direction of rotation for both rotors.

Figure 5:
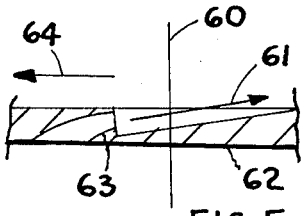
FIG. 5 is a detail of rotor nozzles.

In FIG. 5, a detail of rotor nozzles is shown. 60 is orientation of shaft about which the rotor rotates, 61 is direction of first fluid leaving nozzles 63, 62bis rotor dividing wall into which said nozzles are mounted, and 64 is direction of rotation of the rotor.

In operation, the first fluid is compressed within said first rotor by centrifugal action on said fluid by said rotor with accompanying temperature increase; this temperature increase provides the temperature differential to pass heat from said first fluid to said second fluid, with said second fluid being either a liquid or a gas with a temperature increase that is less than the temperature increase for said first fluid. After heat transfer, said first fluid is passed through said nozzles mounted near the periphery of said first rotor with said nozzles oriented to discharge said first fluid backward thus reducing the absolute tangential velocity of said first fluid. After leaving said first rotor nozzles, said first fluid enters said second rotor first fluid passages passing inward toward rotor center with vanes within said second rotor assuring that said first fluid will rotate with said second rotor, and said vanes recovering work from said first fluid when said fluid decelerates. In the unit shown in FIG. 3, the first fluid is passed from the second rotor via exit opening 47 near the center of said second rotor. In the unit shown in FIG. 1, heat is added to said first fluid during deceleration and expansion within said second rotor and then said first fluid is passed to the first rotor via openings near the center of both rotors. In the unit shown in FIG. 3, the first fluid is provided from external sources to said first rotor and enters via entry port 58 near the center of said first rotor.

The rotational tangential speed of the said second rotor is normally less, for many fluids, than the tangential speed for said first rotor, to provide for pressure differential required to circulate said first fluid through said rotors. This slower speed for said second rotor means work input to said heat exchanger unit, to circulate said first fluid. To reduce this work input, the nozzles 13 and 42 are provided. Work is supplied to said first rotor to accelerate said first fluid to the rotor tangential velocity, and some of this work is reclaimed in said first rotor nozzles when said first fluid leaves said nozzles in a backward direction. Additional work is then reclaimed in said second rotor. Normally, the shafts of the two rotors are connected by suitable power transmission device to pass the work obtained from said second rotor to said first rotor, with additional work being then supplied from external sources.

The first fluid velocity leaving said first rotor nozzles is usually low. Said nozzles are sized and shaped to obtain the highest attainable velocity for said first fluid relative to said nozzles for the pressure differential available, between entry and exit ends of said nozzles.

The casing of the heat exchanger may be evacuated to reduce fluid friction on external surfaces of the rotor.

Normally the first fluid radial velocity is low within each rotor, and said radial velocity may be controlled by providing suitably sized nozzles 13 or 42. The velocity of first fluid leaving said nozzles is dependent of the required velocity differential between first and second rotors; usually the tip velocity of said second rotor will be the same as the absolute tangential velocity of the first fluid entering said second rotor.

Various controls and governors may be used with the heat exchanger of this invention. They do not form a part of this invention and are not further described herein.

The starting point of the heat exchanger, as measured radially from center of rotation of said first rotor, may be as desired, and as required for the second fluid temperatures. The starting point has been shown different in FIGS. 1 and 3, for this reason; for a second fluid that is relatively cold at entry to heat exchanger 12 or 51, the heat exchanger will start near the rotor center for best efficiency with continuous heat exchange taking place til periphery. Generally, the second fluid and first fluid will both progress together from center to periphery both gaining in temperature, with said second fluid then being returned back from the periphery directly, to passage in rotor shaft.

The fluids used with the heat exchanger of this invention may be either liquids or gases. Said first fluid is normally a gas near the center of the rotors, but may be a liquid near rotor periphery. Alternately, said first fluid may be a suitable liquid at all points. Suitable fluids for use as said first fluid are air, nitrogen, carbon dioxide as gases, and many of the hydrocarbons, and fluids such as carbon disulfide, may be used as liquids. The temperature increase for said first fluid is always greater within said first rotor than for said second fluid. Said second fluid may be either a liquid or a gas. Fluids such as water, liquid ammonia, or other fluids may be used. For the third fluid, water or other fluids may be used.

What is claimed is:

1. A heat exchanger comprising a first rotor and a second rotor, means for mounting said rotors for independent rotation, a closed, first-fluid circulation path through said rotors, circulation path comprising a first passage extending approximately radially outwardly within said first rotor a second passage extending approximately radially outwardly at least partially within said second rotor, first fluid communication means communicating between the radially outward ends of said first and second passages, and second fluid communication means comprising first and second conduits through said first and second rotors respectively, communicating between the radially inward ends of said first and second passages, a heat removal exchanger carried by one of said rotors to remove heat from said first fluid being heated by centrifugal force, and a heat addition heat exchanger carried by one of said rotors to add heat to said fluid being cooled by expansion against centrifugal force.

2. The device of claim 1 wherein said heat removal heat exchanger is provided said first rotor, and said heat addition heat exchanger is provided said second rotor.

3. The device of claim 1 wherein said first communication means includes a nozzle mounted on said first rotor for discharging said first fluid into said second rotor.

* * * * *